US011840883B2

(12) United States Patent
Rupnow et al.

(10) Patent No.: US 11,840,883 B2
(45) **Date of Patent: *Dec. 12, 2023**

(54) SHADE SYSTEM WITH BREAKABLE END TIPS

(71) Applicant: InPro Corporation, Muskego, WI (US)

(72) Inventors: Calvin T. Rupnow, Cedarburg, WI (US); Matthew G. Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 296 days.

This patent is subject to a terminal disclaimer.

(21) Appl. No.: 16/570,539

(22) Filed: Sep. 13, 2019

(65) Prior Publication Data

US 2021/0079725 A1 Mar. 18, 2021

(51) Int. Cl.

| | |
|---|---|
| ***E06B 9/44*** | (2006.01) |
| ***E06B 9/50*** | (2006.01) |
| *E06B 9/58* | (2006.01) |

(52) U.S. Cl.

CPC ..... *E06B 9/44* (2013.01); *E06B 9/50* (2013.01); *E06B 2009/585* (2013.01)

(58) Field of Classification Search

CPC ..... E06B 9/44; E06B 9/50; E06B 9/58; E06B 9/581; E06B 2009/585; E06B 9/42; Y10T 16/364; E05D 15/0626; E05D 15/063

See application file for complete search history.

(56) References Cited

U.S. PATENT DOCUMENTS

| | | | | |
|---|---|---|---|---|
| 1,712,574 | A * | 5/1929 | Mastromonaco | E06B 9/58 160/275 |
| 4,975,207 | A * | 12/1990 | Lee | C08L 75/04 524/494 |
| 5,056,579 | A * | 10/1991 | Krafutler | E06B 9/581 160/271 |
| 5,141,043 | A * | 8/1992 | Kraeutler | E06B 9/08 160/264 |
| 5,454,415 | A * | 10/1995 | Bolling | E06B 9/02 49/55 |
| 5,934,353 | A * | 8/1999 | Buhr | E06B 9/581 160/269 |
| 10,834,920 | B1 * | 11/2020 | Nemeth | A01N 1/0257 |
| 2003/0046870 | A1 * | 3/2003 | Langenbach | E06B 9/581 49/141 |
| 2004/0107655 | A1 * | 6/2004 | Hudoba | E06B 9/90 52/202 |

(Continued)

*Primary Examiner* — Daniel P Cahn
*Assistant Examiner* — Matthew R. Shepherd
(74) *Attorney, Agent, or Firm* — Reinhart Boerner Van Deuren s.c.

(57) ABSTRACT

Embodiments of an end tip configured to travel in a track of a shade system are disclosed. The end tip includes a body portion having a diameter and including a first section and a second section. The first section has a head portion and is made of a first material having a first hardness, and the second section is made of a second material having a second hardness. The head portion has a width that is wider than the diameter of the body portion, and the first hardness is higher than the second hardness. Also disclosed is a shade system including first and second tracks, a shade, and end tips. The first and second sections of the end tips are configured to separate when a threshold load is applied to the end tips.

19 Claims, 4 Drawing Sheets

(56) References Cited

U.S. PATENT DOCUMENTS

| | | | | |
|---|---|---|---|---|
| 2005/0211397 | A1* | 9/2005 | Coenraets | E06B 9/582 160/271 |
| 2006/0000560 | A1* | 1/2006 | Lewis | E06B 9/266 160/38 |
| 2012/0241110 | A1* | 9/2012 | Drifka | E06B 9/581 160/271 |
| 2014/0130989 | A1* | 5/2014 | Chan | E06B 9/78 160/309 |
| 2015/0308187 | A1* | 10/2015 | Lu | E06B 9/581 160/319 |
| 2016/0130871 | A1* | 5/2016 | Pham | E06B 9/42 248/201 |
| 2016/0177624 | A1* | 6/2016 | Palencia | E06B 9/70 160/267.1 |
| 2016/0376842 | A1* | 12/2016 | Brondex | E06B 9/40 160/7 |
| 2017/0009524 | A1* | 1/2017 | Dwarka | E06B 9/42 |
| 2017/0022756 | A1* | 1/2017 | Kao | E06B 9/78 |
| 2017/0044826 | A1* | 2/2017 | Nakae | E06B 9/581 |
| 2017/0211315 | A1* | 7/2017 | Fleischman | E06B 9/174 |
| 2018/0371833 | A1* | 12/2018 | Klish | E06B 9/13 |
| 2020/0386047 | A1* | 12/2020 | James | E06B 9/58 |

* cited by examiner

SHADE SYSTEM WITH BREAKABLE END TIPS

BACKGROUND OF THE INVENTION

The present invention relates generally to the field of shade systems. The present invention relates specifically to shade systems usable in behavioral health facilities.

In behavioral health facilities, some patients are at risk of harming themselves and will use whatever objects that may be around them to that effect. Thus, in behavioral health facilities, structures and components must be designed to substantially limit their ability to be used by patients who may wish to harm themselves. Embodiments of the present invention relate to a shade system that addresses this need in the art.

SUMMARY OF THE INVENTION

Embodiments of the present disclosure relate to an end tip configured to travel in a track of a shade system. The end tip includes a body portion having a diameter and including a first section and a second section. The first section has a head portion and is made of a first material having a first hardness, and the second section is made of a second material having a second hardness. The head portion has a width that is wider than the diameter of the body portion, and the first hardness is higher than the second hardness.

Another embodiment of the present disclosure relates to a shade system. The shade system includes a first track having a C-shaped cross-section with two inwardly projecting lips separated by a distance and a second track having a C-shaped cross-section with two inwardly projecting lips separated by the distance. The shade system also includes a shade having a loop of shade material and a rail contained in the loop of shade material. Further, the shade system includes a first end tip extending from a first side of the rail and a second end tip extending from a second side of the rail. The first end tip is configured to move along the first track during normal operation, and the second end tip is configured to move along the second track during normal operation. Each of the first end tip and the second end tip having a body portion with a diameter and including a first section and a second section. The first section has a head portion and is made of a first material having a first hardness, and the second section is made of a second material having a second hardness. The first hardness is higher than the second hardness. The head portion of each of the first end tip and the second end tip has a width that is wider than the distance between the inwardly projecting lips of the first and second tracks, and the diameter of the body portion of each of the first end tip and the second end tip is less than the distance between the projecting lips of the first and second tracks. Further, the first section and the second section of the respective first end tip or the second end tip separate when a load at or above a threshold load is applied to the respective first end tip or the second end tip.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present invention is not limited to the details or methodology set forth in the description or illustrated in the figures. It should also be understood that the terminology is for the purpose of description only and should not be regarded as limiting.

Generally, embodiments of a shade system are provided. The shade system has a shade carrying a rail with two end tips that move along respective tracks. In order to prevent a patient from using the end tips as a tie-off point from which a length of cord, rope, sheet, etc. can be secured, the end tips are configured to break such that shade is detached from the track when a weight of at least 10 lbs. is applied to the end tips. In particular, the end tips will break even if the weight is a static weight, i.e., the end tips do not require a sudden impulse or dynamic loading to break so that the shade can detach from the track. As will be described below, the end tips are made of two materials with two different hardnesses. A first, softer material is molded over the second, harder material such that harder material pulls out from the softer material when a load is applied to one or both end tips. The second, harder material provides durability for the end tip as it slides within the track. Additionally, the tracks in which the end tips move are angled at the top end so as to eliminate potential tie-off points. These and other aspects and advantages will be discussed in relation to the embodiments described below.

Figure 1:
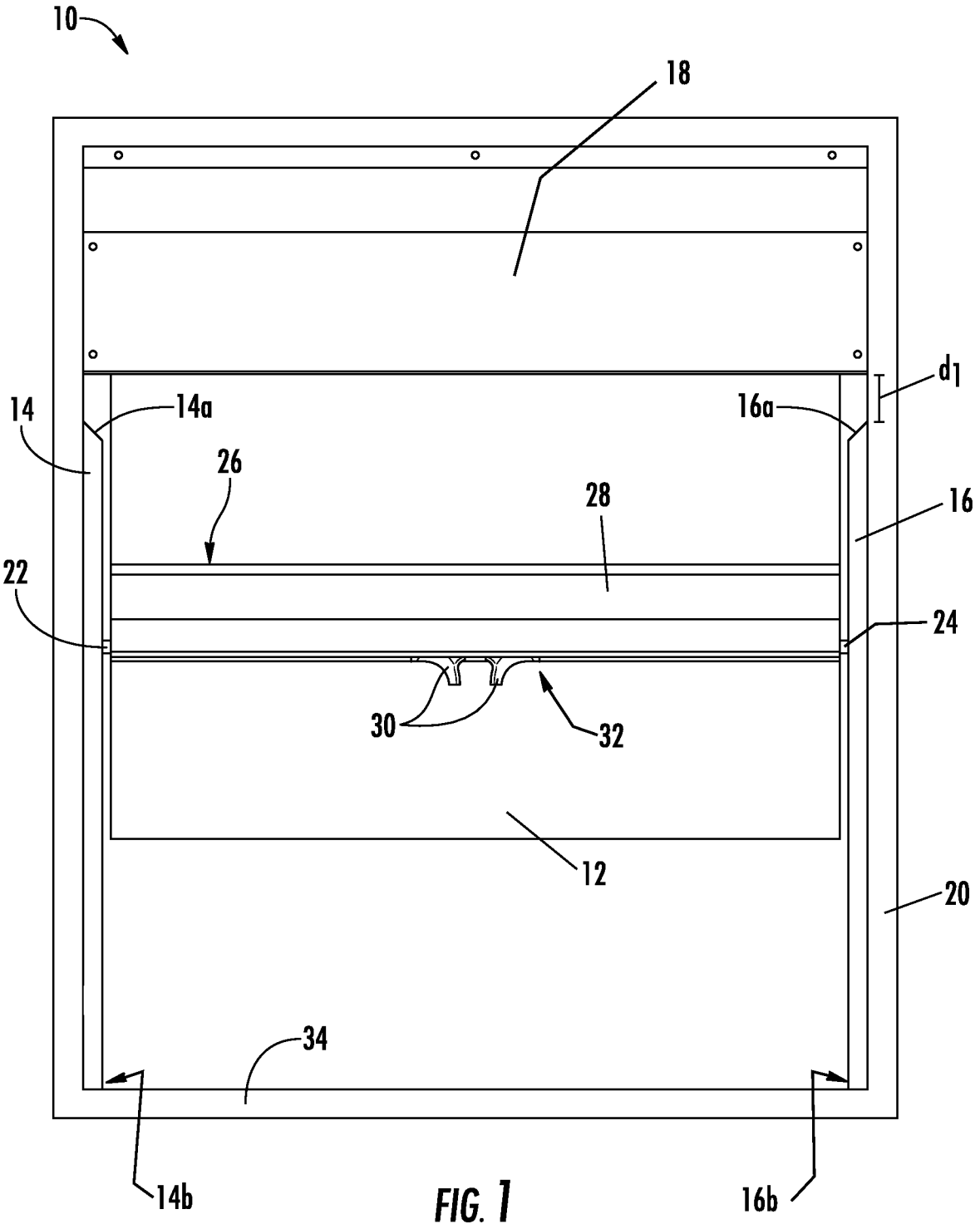
FIG. 1 depicts a front view of the shade system, according to an exemplary embodiment.

Referring to the FIG. 1, a shade system 10 is provided, which generally includes a shade 12, a first track 14, and a second track 16. As can be seen, the shade 12 is disposed between the first track 14 and the second track 16, and the shade 12 extends downwardly from and retracts upwardly into a security box 18 that houses a system configured to extend and retract the shade 12. As can also be seen in FIG. 1, the security box 18 is arranged above the first track 14 and the second track 16. As depicted in FIG. 1, the shade system 10 is set into or mounted onto a window frame 20. While the shade system 10 is depicted as being inside the window frame 20 in FIG. 1, in other embodiments, the shade system 10 is mounted outside of the window frame 20, e.g., secured to a wall surrounding the window, and in still other embodiments, the shade system 10 is integrated into the window frame 20. Further, those of ordinary skill in the art will understand from the present disclosure that the size and location of the window frame 20 will vary depending on the architectural design choices of the building in which the window frame 20 is situated and the shade system 10 is generally scalable with the dimensions of the window frame 20.

The shade 12 travels upwardly and downwardly along the tracks 14, 16. During normal operation, movement of the shade 12 is restricted to within the plane defined by the tracks 14, 16 by a first end tip 22 and a second end tip 24 that travel along the path defined by the tracks 14, 16. In the embodiment depicted, the shade 12 stops at predetermined stopping points along the tracks 14, 16. In particular, the shade 12 is kept in tension such that the shade 12 would retract but for the end tips 22, 24 abutting projections in the tracks 14, 16 at the predefined stopping points. In embodiments, the projections may be rounded heads of screws that attach the tracks 14, 16 to the window frame 20. In other embodiments, the projections are ramps formed during fabrication of the tracks 14, 16 that allow the end tips 22, 24 to slide downwardly over the ramps but prevent the end tips 22, 24 from sliding upwardly. In order to move past the projections in the tracks 14, 16, the end tips 22, 24 are mechanically engaged with a retraction mechanism in a rail 26 extending across the shade 12. The rail 26 is contained within a loop 28 of material formed on the shade 12. The retraction mechanism is actuated by finger clips 30 that extend from an opening 32 in the loop 28. When the finger clips 30 are pinched together, the retraction mechanism draws the end tips 22, 24 into the rail 26 so that the end tips 22, 24 can pass over the projections in the tracks 14, 16. As will be discussed more fully below, the end tips 22, 24 are shaped such that they are prevented from being pulled from the tracks 14, 16. Retraction mechanisms of this variety are known and incorporated in WebbLok® shades (available from InPro Corporation, Muskego, WI). Upon raising or lowering the shade 12 to the desired position, the finger clips 30 are released, and a spring within the rail 26 causes the end tips 22, 24 to extend from the rail 26 and engage the projections in the tracks 14, 16 at the new desired stopping point.

In another embodiment, the shade 12 is carried on a continuous roller, which allows the shade to be positioned at any vertical position along the tracks 14, 16. In such an embodiment, the tracks 14, 16 do not contain any projections that define stopping points. Further, because the end tips 22, 24 do not have to pass over any projections in the tracks 14, 16, the rail 26 does not need to contain the retraction mechanism or finger clips 30. In the continuous roller embodiment, the shade 12 still contains the rail to balance against the continuous roller, and the rail 26 also provides a grip to manipulate the vertical position of the shade 12. In the continuous roller embodiment, the end tips 22, 24 confine the movement of the shade 12 to the plane defined by the tracks 14, 16.

Having described the general operation of the shade system 10, the enhancement features of the shade system will be described. As can be seen in FIG. 1, the tracks 14, 16 do not extend the entire length between the security box 18 and the bottom sill 34 of the window frame 20. In particular, first ends 14*a*, 16*a* of the tracks 14, 16 are spaced from the security box 18 by a distance $d_1$. In this way, a tether cannot be wedged between the security box 18 and either track 14, 16. In embodiments, the first distance $d_1$ is greater than 1 inch.

Figure 6:
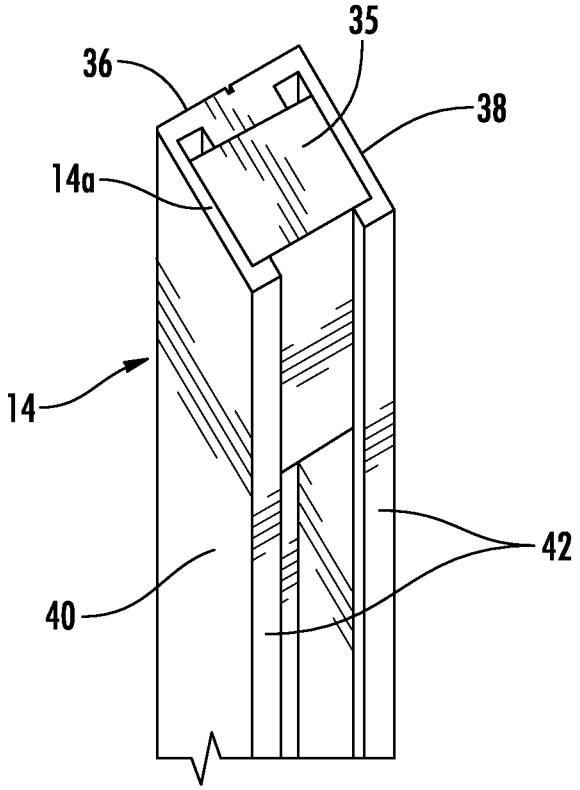
FIG. 6 depicts an angled end of a track and an angled plug at the angled end of the track of the shade system, according to an exemplary embodiment.

Additionally, as shown in FIGS. 1 and 6, first ends 14*a*, 16*a*, at the top of each track 14, 16 are angled (e.g., at an angle of 30°-60°, particularly about 45°) so that a rope, cord, sheet, or other tether cannot be attached to the tracks 14, 16. Further, as shown in FIG. 6, the first end 14*a* of the first track 14 may include an angled plug 35 to prevent the end tip 22 from exiting the track 14 during normal operation when the shade 12 is raised. The angled plug 35 also helps prevent the first end 14*a* from being used as a tie-off point. While an angled plug 35 is only shown in relation to the first track 14 in FIG. 6, a substantially identical angled plug 35 may be incorporated into the second track 16. In embodiments, an angled plug 35 may be secured in each of the tracks 14, 16 using an adhesive or by fastening the angled plug 35 to the track 14 (e.g., using a screw).

Returning to FIG. 1, second ends 14*b*, 16*b* of the tracks 14, 16 extend to the bottom sill 34 of the window frame 20. In this way, the end tips 22, 24 are prevented from exiting the tracks 14, 16 through the second ends 14*b*, 16*b* of the tracks 14, 16.

Figure 2:
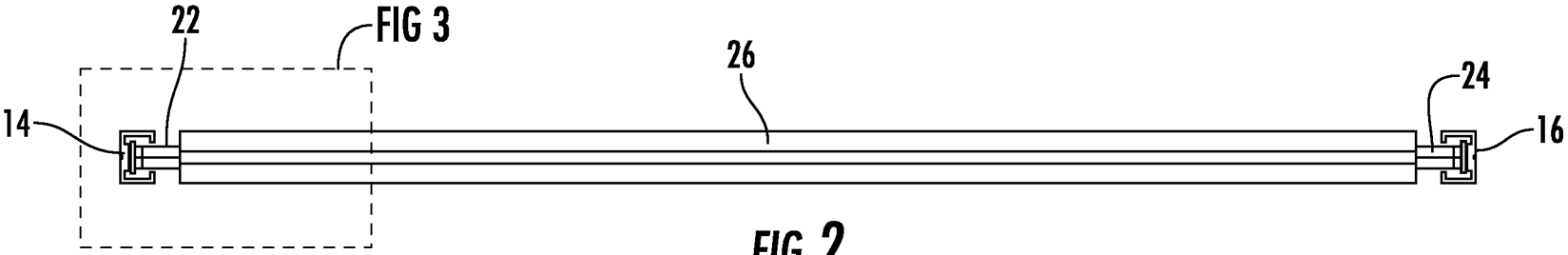
FIG. 2 depicts a plan view of the rail, end tips, and tracks of the shade system, according to an exemplary embodiment.
Figure 3:
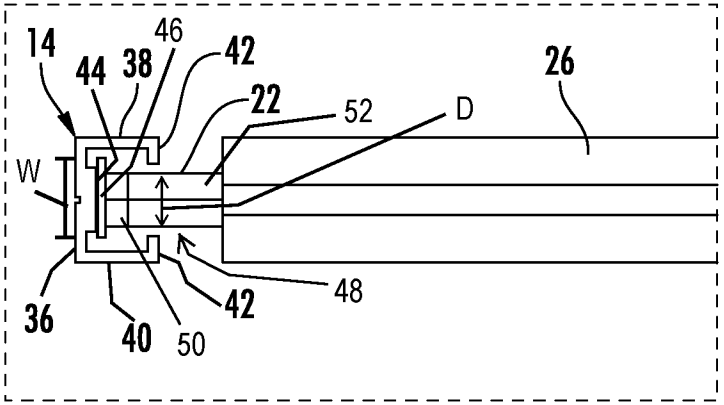
FIG. 3 depicts a close-up view of a track and end tip of the shade system shown in FIG. 2, according to an exemplary embodiment.

FIG. 2 depicts a view of the rail 26, end tips 22, 24, and tracks 14, 16. As can be seen, the end tips 22, 24 and rail 26 extend substantially the entire span between the tracks 14, 16. FIG. 3 depicts a close-up view of the first track 14 and the first end tip 22, and the following discussion of the first track 14 and the first end tip 22 applies equally to the second track 16 and the second end tip 24. As shown in FIG. 3, the first track 14 has a generally C-shaped cross-section with a sidewall 36, a first extension member 38 and a second extension member 40. The first extension member 38 and the second extension member 40 are arranged substantially perpendicularly to the sidewall 36. The first extension member 38 and the second extension member 40 each have an inwardly projecting lip 42. The inwardly projecting lips 42 are substantially parallel to the sidewall 36 and prevent the first end tip 22 from being pulled out of the track 14. As can be seen in FIG. 3, embodiments of the track 14 include a raised travel surface 44 that extends from the sidewall 36. The first end tip 22 contacts the travel surface 44 of the sidewall 36 of the track 14.

In FIG. 3, the general shape of the first end tip 22 can be seen. In particular, the first end tip 22 includes a head portion 46 having a width W wider than the distance between the inwardly projecting lips 42. In this way, the first end tip 22 cannot leave the first track 14 during normal operation. In the embodiment depicted, the head portion 46 has square shape, but in other embodiments, the head portion 46 can be any of a variety of other polygonal or curved shapes, such as circular, oval, rectangular, octagonal, hexagonal, etc. The head portion 46 is connected to a body portion 48 that extends from the rail 26. The body portion 48 has a diameter D that is less than the distance between the inwardly projecting lips 42, and thus, the head portion 46 has a width W greater than the diameter D of the body portion 48. The body portion 48 includes a first section 50 and a second section 52 that are made of different materials. In embodiments, the first section 50 and the head portion 46 are of unitary construction and are made from a first material. The second section 52 of the body portion 48 is made from a second material that is softer than the first material (that is, the first material has a higher hardness than the second material).

Figure 4:
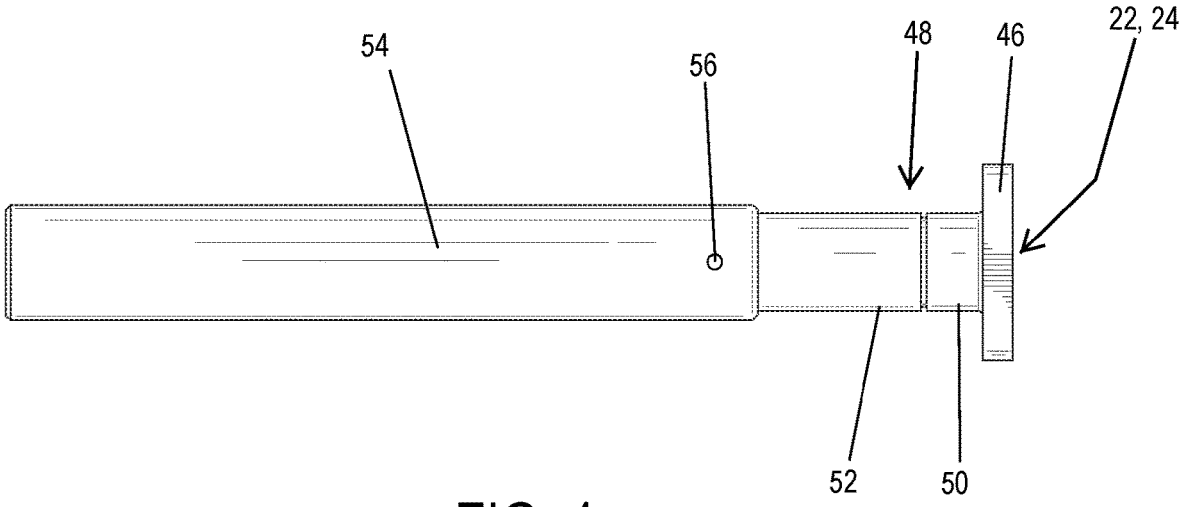
FIG. 4 depicts an end tip and rod, according to an exemplary embodiment.

As shown in FIG. 4, the first end tip 22 is mounted on a rod 54 that is inserted into the rail 26 (as shown in FIG. 3). In the embodiment depicted, the second section 52 extends into the rod 54 and is secured in the rod 54 with a set screw 56, although, other fasteners, pins, adhesives, etc. can be used in other embodiments. The position of the first end tip 22 in relation to the rail 26 can be adjusted by moving the rod 54 in or out of the rail 26. In an embodiment, the rail 26 includes an internal threaded member, and the rod 54 has an internal bore that can be rotated along the threads to move the rod 54 (and consequently the first end tip 22) in and out of the rail 26. The ability to move the first end tip 22 in relation to the rail 26 facilitates installation of the shade system 10 and ensures that the first end tip 22 will not leave the track 14 during normal operation of the shade system 10. It should be noted that the second end tip 24 also is mounted on a rod 54 and is substantially identical to the depiction of the first end tip 22 and rod 54 shown in FIG. 4.

As mentioned above, the end tips 22, 24 are made of two different materials. With reference to the first end tip 22 shown in FIG. 5, the first section 50 and head portion 46 are made from a first material relatively harder than the material of the second section 52. In embodiments, the second section 52 is molded over the first section 50. In order to create a secure connection between the first section 50 and the second section 52, the first section 50 is provided with a neck region 58 and a shoulder region 60. The neck region 58 has a smaller diameter than the shoulder region 60, and the shoulder region 60 has a smaller diameter than the body portion 48. In this way, the second section 52 molds around the shoulder region 60, creating an internal lip 62 (as shown in the partial cross-section of FIG. 5) that forms around the neck region 58. Thus, the shoulder region 60 of the first section 50 is locked into the interior of the second section 52 via the internal lip 62.

The material of the first section 50 is selected to be relatively harder than the material of the second section 52 because the first section 50 travels against the first track 14, which can cause wear over time. Thus, in embodiments, the first section 50 is made from a material having a Shore D durometer of more than 65. Example materials for the first section 50 include polyamides (e.g., nylon), acrylonitrile butadiene styrene (ABS), polyoxymethylene (POM or acetal), or other similar wear-resistant polymers.

The second section 52 is made from a relatively more pliant or softer material than the first section 50. When a weight of at least 10 lbs (either statically or dynamically) is applied to the end tip 22, 24, the first respective section 50 separates from the second respective section 52 by pulling the shoulder region 60 past the internal lip 62. The shoulder region 60 can be pulled past the internal lip 62 because of the relatively more pliant material from which the second section 52 is made. However, during normal operation, the material of the second section 52 is stiff enough such that the shoulder region 60 does not accidentally pull from the second section 52. In embodiments, the second section 52 is made from a material having a Shore D hardness of 65 or less. In embodiments, the second section 52 is made from a thermoplastic polyurethane or another similar pliant polymer. While the first section 50 and the second section 52 are depicted as being cylindrical, the first section 50 and the second section 52 could have different prismatic shapes, such as triangular, rectangular, and other polygonal prisms. It should be noted that the second end tip 24 is substantially identical to the first end tip 22 as described in relation to FIGS. 4 and 5.

As mentioned above, the end tips 22, 24 as described are designed to break apart such that shade 12 disengages the tracks 14, 16 when loaded at or above a threshold amount. In embodiments, the end tips 22, 24 are configured to break apart when placed under a static load of at least 10 lbs. In other embodiments, the end tips 22, 24 are configured to break apart when placed under a static load of at least 20 lbs. In still another embodiment, the end tips 22, 24 are configured to break apart when placed under a static load of at most 70 lbs. (i.e., the end tips 22, 24 can be placed under a static load of no more than 70 lbs. before breaking apart). The end tips 22, 24 will also typically break apart at these threshold amounts if the load is dynamic as opposed to static as generally the application of a dynamic load will cause the end tips 22, 24 to break apart easier than application of a static load.

Figure 5:
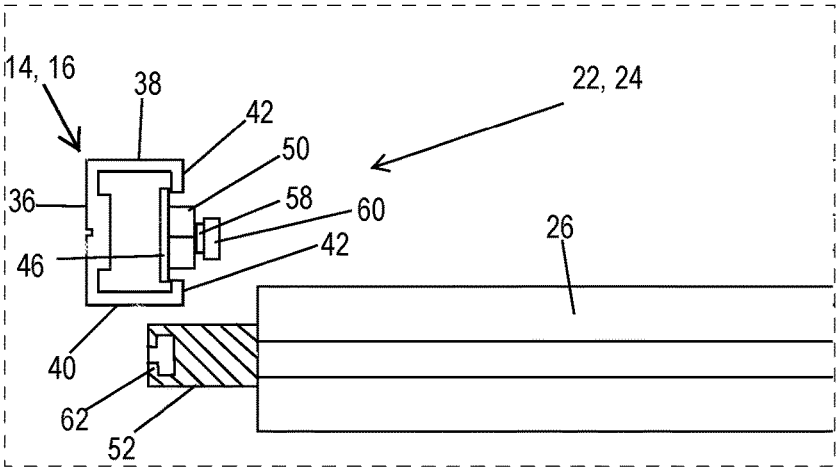
FIG. 5 depicts an end tip in which the first section has separated from the second section, according to an exemplary embodiment.

Advantageously, the end tips 22, 24 are configured to break apart in situations where a patient may be attempting to harm himself or herself but not to break apart during normal operation, which, according to the present disclosure, is achieved by using two materials of different hardness in the construction of the end tips 22, 24. Conventional end tips for certain shade systems were made of a single material, which was selected based on the mechanical wear considerations of the end tips moving within the track. However, these end tips would only break upon application of over 100 lbs. of static and dynamic loading. Moreover, by providing the preferential break area between the first section 50 and the second section 52, the shape of the resulting fragments can be controlled. As shown in FIG. 5, there are no sharp edges where the first section 50 separates from the second section 52. In contrast, previous designs did not control the fragments produced in a breakage, which could produce sharp or jagged edges that a patient may use to harm himself or herself instead.

In embodiments, the end tips 22, 24 may be provided to a customer for retrofitting to an existing shade system. Exemplary shade systems that may be retrofit with the end tips 22, 24 include WebbLok® shade system (manufactured by InPro Corporation, Muskego, WI). In embodiments, the end tips 22, 24 may each be provided with a rod 54 for insertion into the rail 26 of the existing shade system.

In various exemplary embodiments, the relative dimensions, including angles, lengths and radii, as shown in the Figures are to scale. Actual measurements of the Figures will disclose relative dimensions and angles of the various exemplary embodiments. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A separating shade rail assembly contained within a loop of material of a shade of a shade system and configured to travel in a pair of tracks of the shade system, comprising:

a rail having a center portion extending between a first end and a second end of the rail, each end formed from a first material having a first hardness, wherein each end includes an internal lip formed within the first material, wherein the internal lip defines an internal recess;

a first head portion configured to travel within a first track in the pair of tracks of the shade system, the first head portion coupled to a first shoulder portion by a first neck portion; and a second head portion configured to travel within a second track in the pair of tracks of the shade system, the second head portion coupled to a second shoulder portion by a second neck portion;

the first and second head portions, first and second shoulder portions, and first and second neck portions formed from a second material having a second hardness greater than the first hardness;

wherein the first shoulder portion is located within the internal recess of the first end and the internal lip of the first end engages the first neck portion to retain the first shoulder portion within the internal recess of the first end;

wherein the second shoulder portion is located within the internal recess of the second end and the internal lip of the second end engages the second neck portion to retain the second shoulder portion within the internal recess of the second end; and wherein the difference between the first hardness and the second hardness allows at least one of the shoulder portions to pull from and separate from the respective internal recess when a load at or above a threshold load is applied to the rail, wherein a first rod is attached to a center position of the rail, and a second rod is attached to the center position of the rail.

2. The separating shade rail assembly of claim 1, wherein the first end is overmolded over the first neck portion and first shoulder portion, and wherein the second end is overmolded over the second neck portion and second shoulder portion.

3. The separating shade rail assembly of claim 1, wherein the second material comprises at least one of a polyamide, polyoxymethylene, or acrylonitrile butadiene styrene.

4. The separating shade rail assembly of claim 1, wherein the first material comprises a thermoplastic polyurethane.

5. The separating shade rail assembly of claim 1, wherein the first hardness is a Shore D hardness of no more than 65.

6. The separating shade rail assembly of claim 1, wherein the first end is attached to the first rod by a first internal bore, and wherein the second end is attached to the second rod by a second internal bore.

7. The separating shade rail assembly of claim 1, wherein the threshold load is at least 10 lbs.

8. The separating shade rail assembly of claim 7, wherein the load is applied statically or dynamically.

9. A shade system, comprising:

a first track having a C-shaped cross-section with two inwardly projecting lips separated by a distance;

a second track having a C-shaped cross-section with two inwardly projecting lips separated by the distance;

a shade having a loop of shade material;

a rail contained in the loop of shade material;

a first end tip extending from a first side of the rail formed from a first material having a first hardness, wherein the first end tip includes a first internal lip that defines a first internal recess;

a second end tip extending from a second side of the rail formed from the first material, wherein the second end tip includes a second internal lip that defines a second internal recess;

a first head portion coupled to a first shoulder portion by a first neck portion, the first head, shoulder, and neck portions formed from a second material having a second hardness greater than the first hardness, wherein the first shoulder portion is located within the first internal recess of the first end tip;

a second head portion coupled to a second shoulder portion by a second neck portion, the second head, shoulder, and neck portions formed from the second material, wherein the second shoulder portion is located within the second internal recess of the second end tip;

wherein the first head portion is configured to move along the first track during normal operation and the second head portion is configured to move along the second track during normal operation;

wherein each of the first head portion and the second head portion has a width that is wider than the distance between the inwardly projecting lips of the first and second tracks, respectively, and a diameter of each of the first end tip and the second end tip is less than the distance between the inwardly projecting lips of the first and second tracks, respectively; and wherein the difference between the first hardness and the second hardness allows at least one of the shoulder portions to pull from and separate from the respective internal recess when a load at or above a threshold load is applied to the rail, wherein the shade system further comprises a first rod at least partially inserted into the rail and extending from the first side of the rail, wherein the first end tip is coupled to the first rod; and a second rod at least partially inserted into the rail and extending from the second side of the rail, wherein the second end tip is coupled to the second rod.

10. The shade system of claim 9, wherein the shade system is installed in a window frame having a bottom sill; wherein the first track further comprises a first end and an opposing second end and the second track further comprises a first end and an opposing second end; and wherein the second ends of the first track and the second track extend to the bottom sill such that substantially no space is provided between the bottom sill and the second ends of the first and second tracks.

11. The shade system of claim 10, wherein at least a portion of the shade is retractably housed within a security box, wherein first ends of the first track and the second track in proximity to the security box are spaced from 1 inch to 3 inches away from the security box.

12. The shade system of claim 11, wherein the first ends of the first track and the second track are angled.

13. The shade system of claim 12, wherein an angled plug is contained in each of the first track and the second track at the first ends of the first track and the second track.

14. The shade system of claim 12, wherein the first ends of the first and second tracks are angled between 30 degrees and 60 degrees.

15. The shade system of claim 13, wherein, upon separation of the first or second shoulder portion from the respective internal recess of the end tip, the corresponding first or second head portion is retained in the respective first or second track between the angled plug and the bottom sill.

16. The shade system of claim 9, wherein the first hardness is a Shore D hardness of no more than 65.

17. The shade system of claim 16, wherein the second material comprises at least one of a polyamide, polyoxymethylene, or an acrylonitirile butadiene styrene and wherein the first material comprises a thermoplastic polyurethane.

18. The shade system of claim 9, wherein the first end tip is overmolded over the first neck portion and first shoulder portion, and wherein the second end tip is overmolded over the second neck portion and second shoulder portion.

19. The shade system of claim 9, wherein the threshold load is at least 10 lbs. and wherein the load is applied statically or dynamically.

* * * * *